United States Patent [19]

Sasaoka

[11] 4,007,555

[45] Feb. 15, 1977

[54] COMBINATION OF BLOCK UNITS

[75] Inventor: Nobuhiko Sasaoka, Tokyo, Japan

[73] Assignee: Okamura Co., Ltd., Tokyo, Japan

[22] Filed: Jan. 8, 1976

[21] Appl. No.: 647,623

[52] U.S. Cl. ..... 46/25; 35/27; 52/394; 273/157 R

[51] Int. Cl.[2] ..... A63H 33/08

[58] Field of Search ..... 35/27, 72; 46/25; 52/311, 590, 594; 273/157 R, 157 A, DIG. 4

[56] References Cited

UNITED STATES PATENTS

| | | | |
|---|---|---|---|
| 645,800 | 3/1900 | Furness | 52/590 |
| 1,292,188 | 1/1919 | Wheeler | 35/72 X |
| 1,361,501 | 12/1920 | Schepmoes | 52/594 X |
| 2,016,382 | 10/1935 | McBurney | 52/594 X |
| 2,099,149 | 11/1937 | Turnquist | 52/590 |
| 3,562,988 | 2/1971 | Gregoire | 52/594 X |

FOREIGN PATENTS OR APPLICATIONS

| | | | |
|---|---|---|---|
| 141,620 | 4/1920 | United Kingdom | 46/25 |

*Primary Examiner*—Harland S. Skogquist
*Attorney, Agent, or Firm*—McNenny, Pearne, Gordon, Gail, Dickinson & Schiller

[57] ABSTRACT

A combination of block units comprising: a generally H-shaped block unit having a configuration including two symmetrical grooves extending in Y-axis direction in a basic rectangular parallel-piped having X-, Y- and Z-axes intersecting with the right angle with each other, each of the grooves has a base wall which is parallel with X-axis and oppositely inclining side walls intersecting with the base wall with an acute angle, the distance between the centerlines extending in the Y-axis direction on the side walls being half of the length of the parallel-piped in the X-axis direction, a generally T-shaped block unit having a configuration attained by bisecting the H-shaped block unit along the X- and Z-axes thereof, a generally U-shaped block unit having a configuration attained by bisecting the H-shaped block unit along the X- and Y-axes thereof, and a generally T-shaped block unit having a configuration complementary to the U-shaped block unit.

6 Claims, 11 Drawing Figures

Fig. 2B
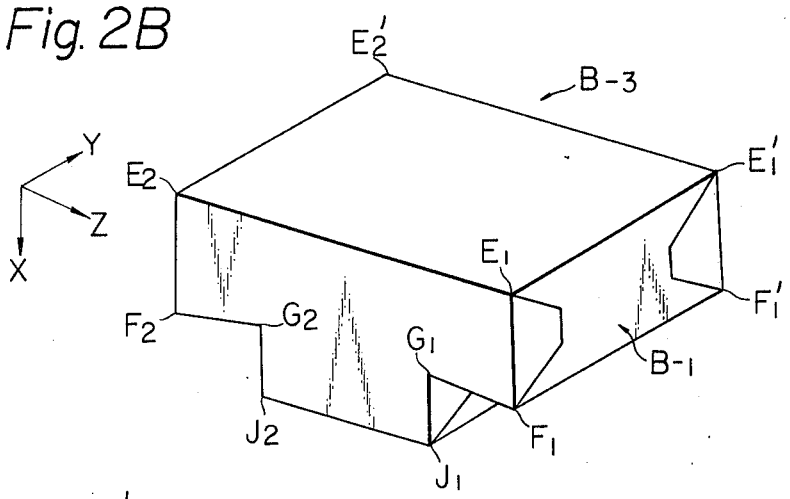
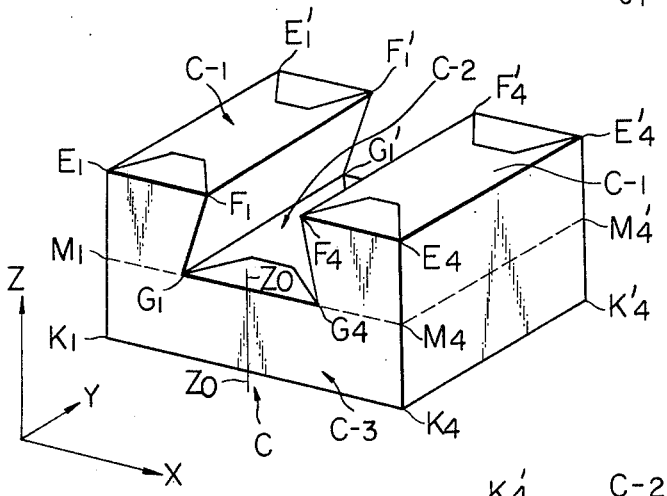
Fig. 3A
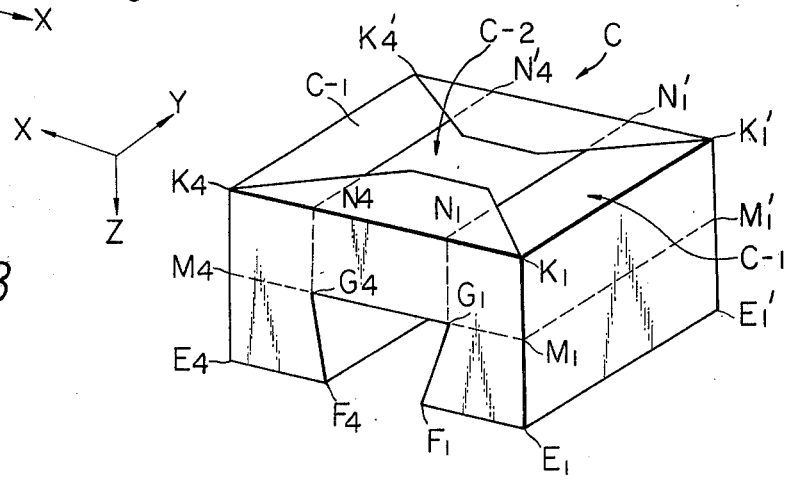
Fig. 3B

COMBINATION OF BLOCK UNITS

BACKGROUND OF THE INVENTION

This invention relates to a combination of block units or a block unit assembly adapted for use as a toy or a teaching material.

A great variety of block unit assemblies comprising one or more kinds of block units have been proposed and widely accepted as a toy or a teaching material, in which the block units are interfittable with each other so as to form various different configurations such as animals, vehicles, architectures or the like.

Most of the prior art block unit assemblies have relyed upon the inherent elastic deformation property of the material in interfitting or disassembling the units. Furthermore, the prior art block unit assemblies formed of plastic or wood have encountered difficulty and inconvenience in handling and stowing the block assemblies because of their bulky configurations.

BRIEF SUMMARY OF THE INVENTION

An object of this invention is to provide a novel and improved block unit assembly which can effectively eliminate the disadvantages inherent in the prior art block unit assemblies referred to hereinabove, and which comprises at least three kinds of block units having generally H-shaped, T-shaped and U-shaped cross-sections, respectively, each of the cross-sections comprise at least two lines which intersect with adjacent lines at an acute angle so as to form an inclined surface, whereby when a block unit is assembled with another block unit the inclined surface defined by the above mentioned line engages with another inclined surface defined by the similar line of the another block unit and a wedge action will occure therebetween so as to prevent the disengagement. Since the interfitting between the block units can be maintained by the wedge action it is not necessary to rely upon the elastic deformation of the material and the disengagement of block units is performed by moving one of the block units in the direction of the plane of the inclined surface relative to the remainder of the block units.

Another object of the present invention resides to provide a block unit assembly comprising the block units each of which is formed of sheet material such as paper board, plastic sheet or the like by folding the sheet material along preformed score lines and then inserting preformed lugs into preformed corresponding slits. Whereby each of the block units can be disassembled into collapsible form to thereby reduce the storage space requirements to a substantial degree.

BRIEF DESCRIPTION OF THE DRAWING

The above objects and attendant advantages of the present invention will be clearly apparent to those skilled in the art from a reading of the following detailed description in connection with the accompanying drawing exemplifying a preferred embodiment of the invention in which:

FIGS. 2A and 2B are perspective views of a generally T-shaped block unit which forms another element of the block unit assembly, in which FIG. 2A is a top view and FIG. 2B is a bottom view.

FIGS. 3A and 3B are perspective views of a generally U-shaped block unit which forms a further element of the block unit assembly, wherein FIG. 3A is a top view and FIG. 3B is a bottom view.

FIGS. 4A and 4B are perspective views of a modified T-shaped block unit which forms a still further element of the block unit assembly, wherein FIG. 4A is a top view and FIG. 4B is a bottom view.

DETAILED DESCRIPTION OF THE EMBODIMENT

Figure 1:
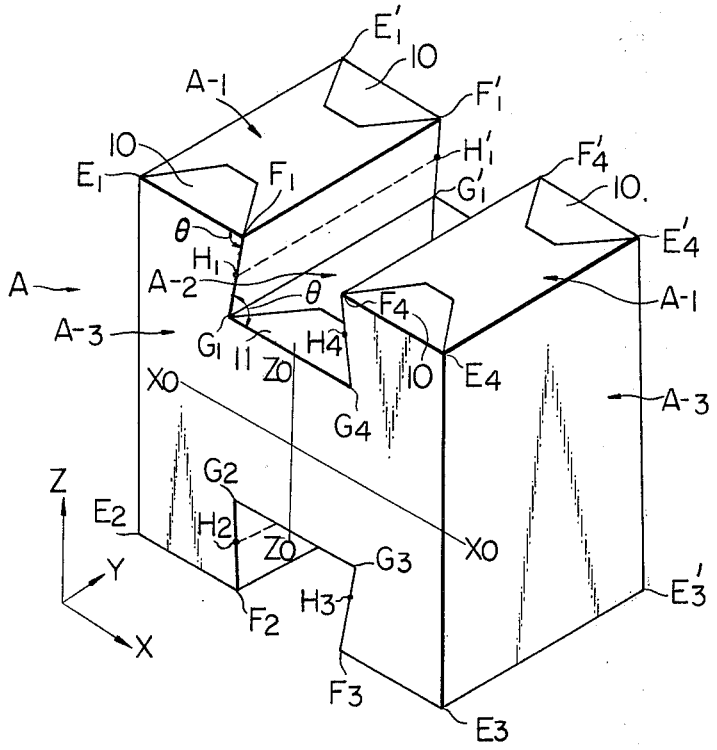
FIG. 1 is a perspective view of a generally H-shaped unit block which forms one element of a block unit assembly according to the present invention.

With reference to FIG. 1 there is shown a generally H-shaped block unit A constituting one element of a block unit assembly according to the present invention.

The configuration of the block unit A is determined by forming two symmetrical grooves $F_1G_1G_4F_4F_1'G_1'G_4'F_4'$($G_4'$ is not shown in the drawing) and $F_2G_2G_3F_3F_2'G_2'G_3'F_3'$ (apexes $F_2'$ - $F_3'$ are not shown in the drawing) extending respectively in Y-axis direction in a basic parallel-piped $E_1E_2E_3E_4E_1'E_2'E_3'E_4'$ (apex $E_2'$ is not shown in the drawing) having three axes X, Y and Z intersecting at the right angle with each other. The groove $F_1G_1G_4F_4F_1'G_1'G_4'F_4'$ has a base wall $G_1G_4G_4'G_1'$ extending in the X- and Y-axes directions and two symmetrically inclined side surfaces or walls $F_1G_1G_1'F_1'$ and $F_4G_4G_4'F_4'$. Each of the inclined side walls intersects with the base wall with an acute angle $\theta$, thus the groove is tapering in the Z-axis direction. The width of the groove measured at the centerlines $H_1H_1'$ and $H_4H_4'$ is half to the width $E_1E_4$ of the block unit A measured in the X-axis direction. Therefore the length of the line $G_1G_4$ is equal to the length of the line $E_1F_1$ plus the length of the line $F_4E_4$.

Figure 2A:
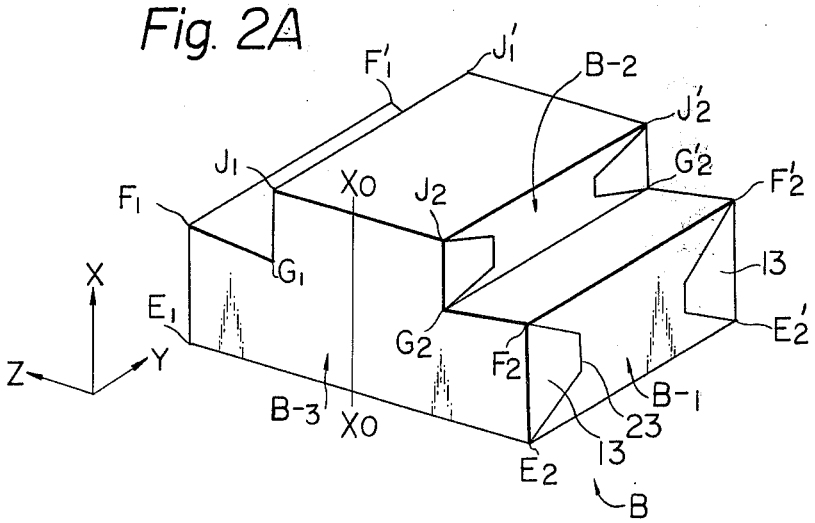

FIGS. 2A and 2B show a generally T-shaped block unit B, and the configuration of which is a half section of the H-shaped block unit A of FIG. 1 along the centerlines extending in the Y- and Z-axes. The apexes corresponding to those of FIG. 1 are denoted by corresponding/ reference characters. It will be noted that the surfaces $G_2F_2F_2'G_2'$ and $G_1F_1F_1'G_1'$ (apex $G_1'$ is not shown in the drawing) constitute the inclined surfaces, and that the length of the line $E_1F_1$ equals to that of the line $G_1J_1$.

FIGS. 3A and 3B show a generally U-shaped block unit C having the configuration equals to a half section of the H-shaped block unit A of FIG. 1 along the centerlines extending along X- Y-axes. The apexes corresponding to those of FIG. 1 are denoted by similar reference characters. It will be noted that a surface $K_1K_1'K_4'K_4$ corresponds to the centerplane of the block unit A extending in X- and Y-axes directions.

Figure 4A:
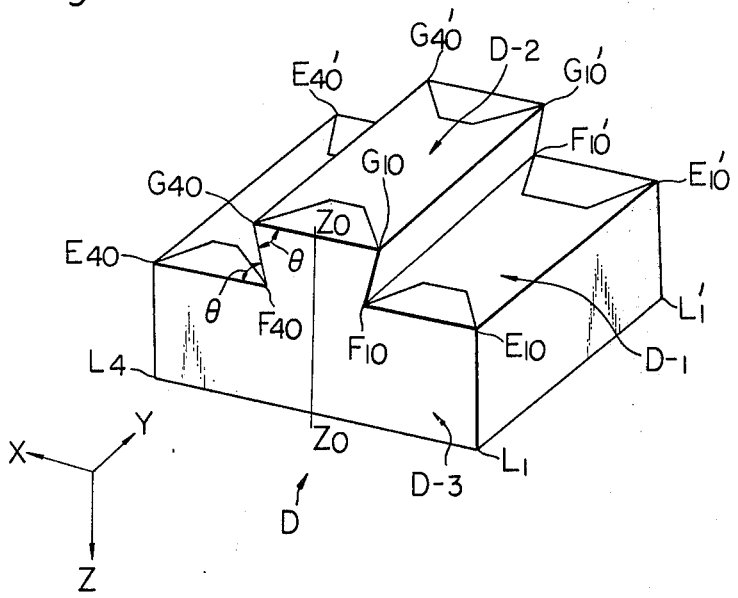
Figure 4B:
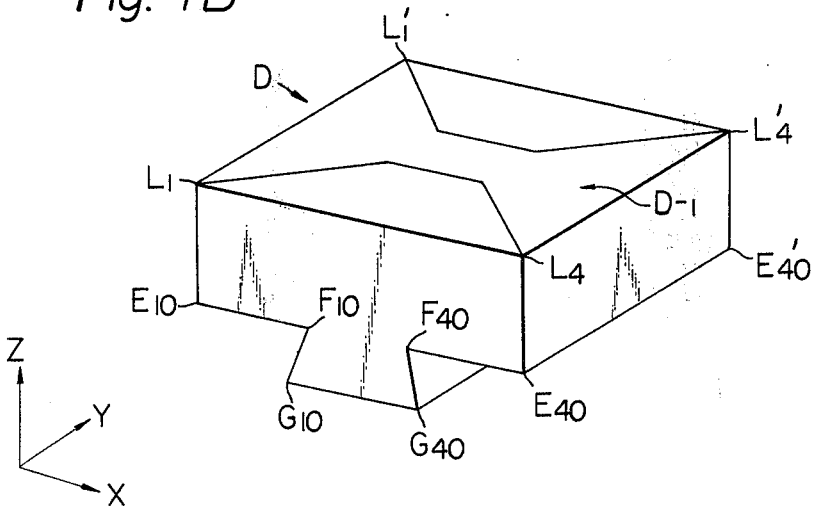

FIGS. 4A and 4B show another generally T-shaped block unit D having the configuration complementary to the block unit C, more particularly, the configuration of a projecting portion $F_{40}G_{40}G_{10}F_{10}F_{10}'G_{10}'G_{40}'F_{40}'$ (apex $F_{40}'$ is not shown) corresponds to the configuration of the groove portion $F_4G_4G_1F_1F_1'G_1'G_4'F_4'$of FIG. 3B and the inclination angle $\theta$ of the inclined surfaces $G_{40}F_{40}F_{40}'G_{40}'$ (apex $G_{40}'$ is not shown in the drawing) with respect to the adjacent surfaces $G_{40}G_{40}'G_{10}'G_{10}$ and $E_{40}F_{40}F_{40}'E_{40}'$ ($E_{40}'$ is not shown in FIG. 4A) is equal to the angle $\theta$ in FIG. 1, further, the dimension of the parallelepiped $E_{40}L_4L_1E_{10}E_{40}'L_4'L_1'E_{10}'$ of FIGS. 4A and 4B equals to that of the parallelepiped $K_1K_1'K_4'K_4M_1M_1'M_4'M_4$ of FIGS. 3A and 3B.

By determining the configuration of each of the block units A, B, C and D as described above, it is possible to combine a plurality of these blocks as desired so as to form a various kinds of forms of animals, vehicles, architectures or the like.

Figure 8:
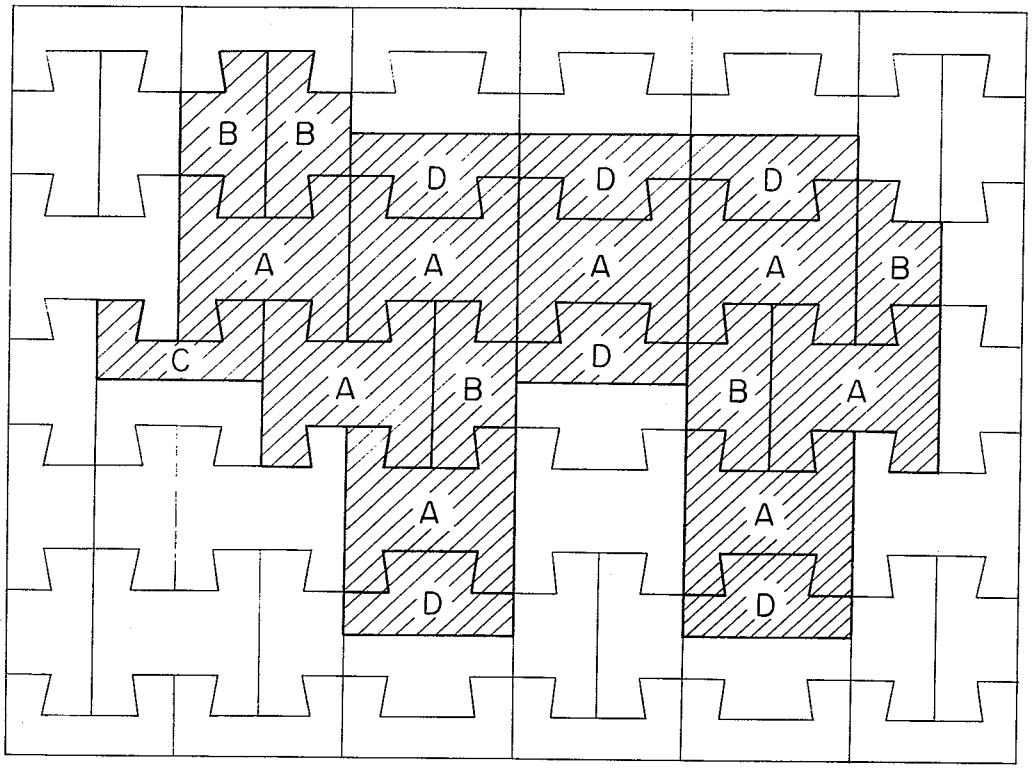
FIG. 8 is a plan view of one illustrative arrangement of the block units.

FIG. 8 shows a combination of eight block units A, five block units B, one block unit C and six block units D for forming an elephant.

In combining the block units the inclined surfaces of each of the block units engage with the corresponding inclined surfaces, thus wedge action for preventing disengagement of the block units will be attained whereby the disengagement can only be attained by moving one of the block units in Y-axis direction relative to the remaining block units.

Further to the above described configurational features, the block units shown in the drawing have another novel feature which will be described hereinafter.

The block unit A shown in FIG. 1 is formed of two inner box members A-1, one inner box member A-2 and one outer closure member A-3, each of which is formed of sheet material such as paperboard or synthetic resin sheet.

In FIG. 1, the inner box member A-2 occupies the spaces enclosed by surfaces $G_1G_4G_4'G_1'$, $G_2G_3G_3'G_2'$, $G_1G_2G_3G_4$, $G_1'G_2'G_3'G_4'$, $G_1G_2G_2'G_1'$ and $G_3G_4G_4'G_3'$, and the respective inner box members A-1, occupy the remaining respective side portions, namely, the left side portion having a cross-section defined by a polygon $E_1E_2F_2G_2G_1F_1$ and extending along the Y-axis direction, and the right side portion having a cross-section defined by a polygon $E_3E_4F_4G_4G_3F_3$ and extending in the Y-axis direction, respectively. The outer closure member A-3 encloses the inner box members A-1 and A-2 around the surfaces $E_1E_2F_2G_2G_3F_3E_3E_4F_4G_4G_1F_1$, $E_3E_4E_4'E_3'$, $E_1'E_2'F_2'G_2'G_3'F_3'E_3'E_4'F_4'G_4'G_1'F_1'$ and $E_1E_2E_2'E_1'$.

Figure 5:
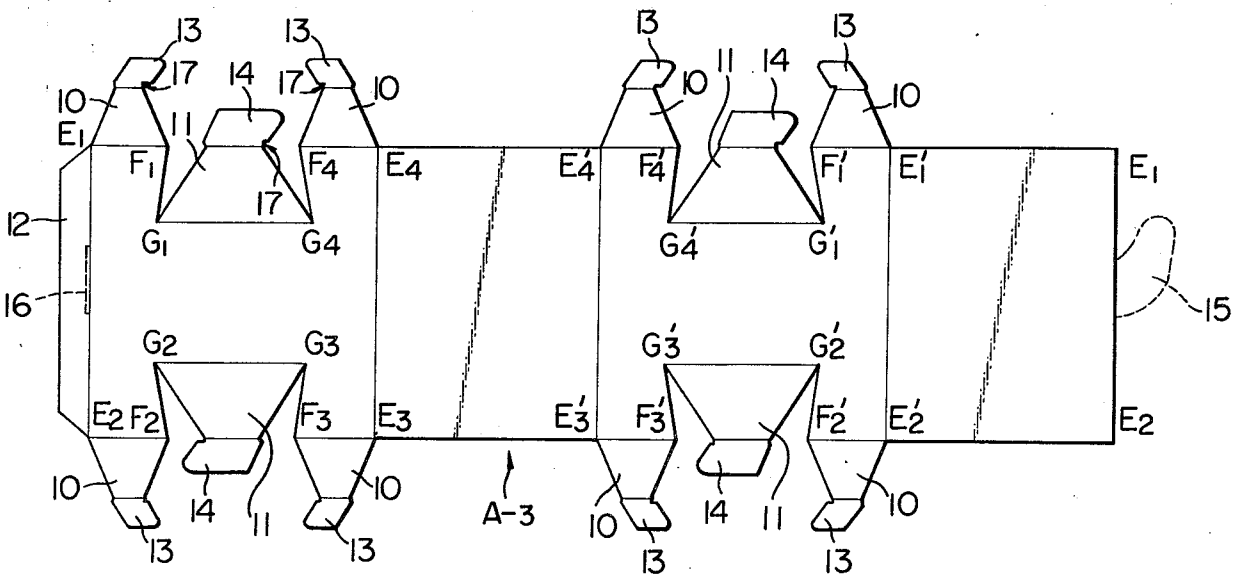
FIG. 5 is a developed view of an outer closure member of the H-shaped block unit as shown in FIG. 1.

As shown in FIG. 5, the outer closure member A-3 is provided with a plurality of flaps 10, 11 and a flap 12. Each of the flaps 10 and 11 has a tab 13, 14 at the tip portion thereof, and the tabs 13 and 14 are inserted through corresponding slits 23 and 24 formed in the inner box members A-1 and A-2 respectively. The flap 12 is secured to the lower surface of the surface $E_1'E_2'E_2E_1$ in FIG. 5 by means of grew or the like. But is is possible to form another flap 15 and a slit 16 as shown in the broken lines so as to allow removable insertion of the flap 15 into the slit 16.

Figure 6:
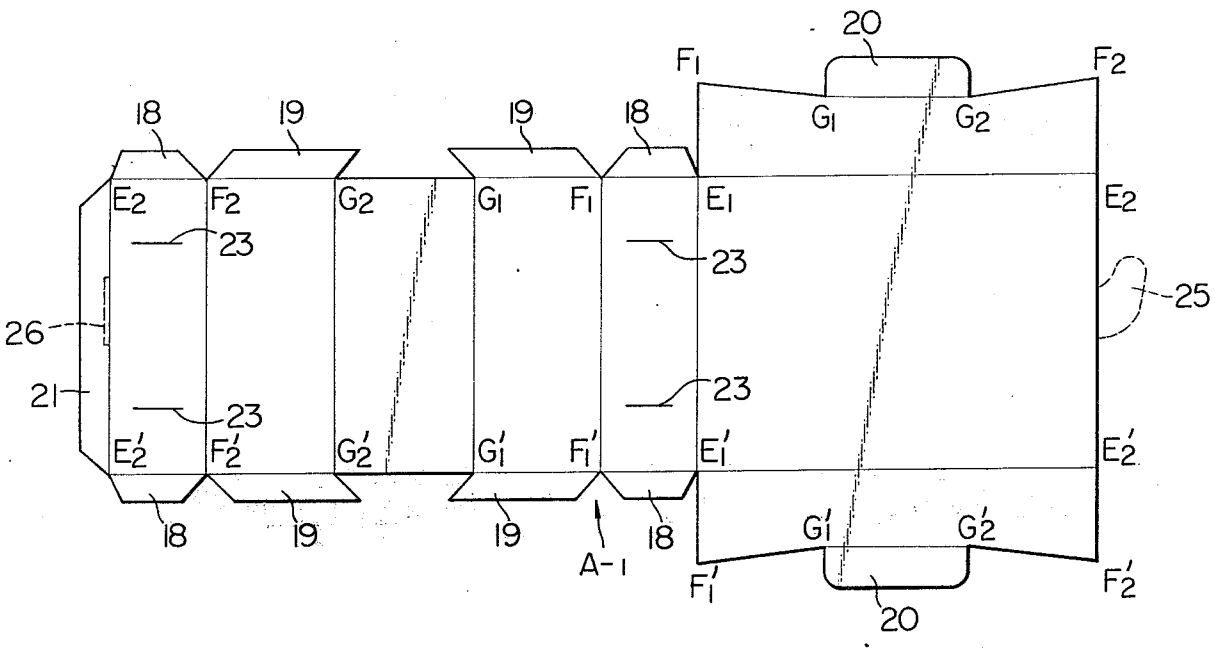
FIG. 6 is a developed view of one of inner box members constituting a structural member of the H-shaped block unit as shown in FIG. 1.
Figure 7:
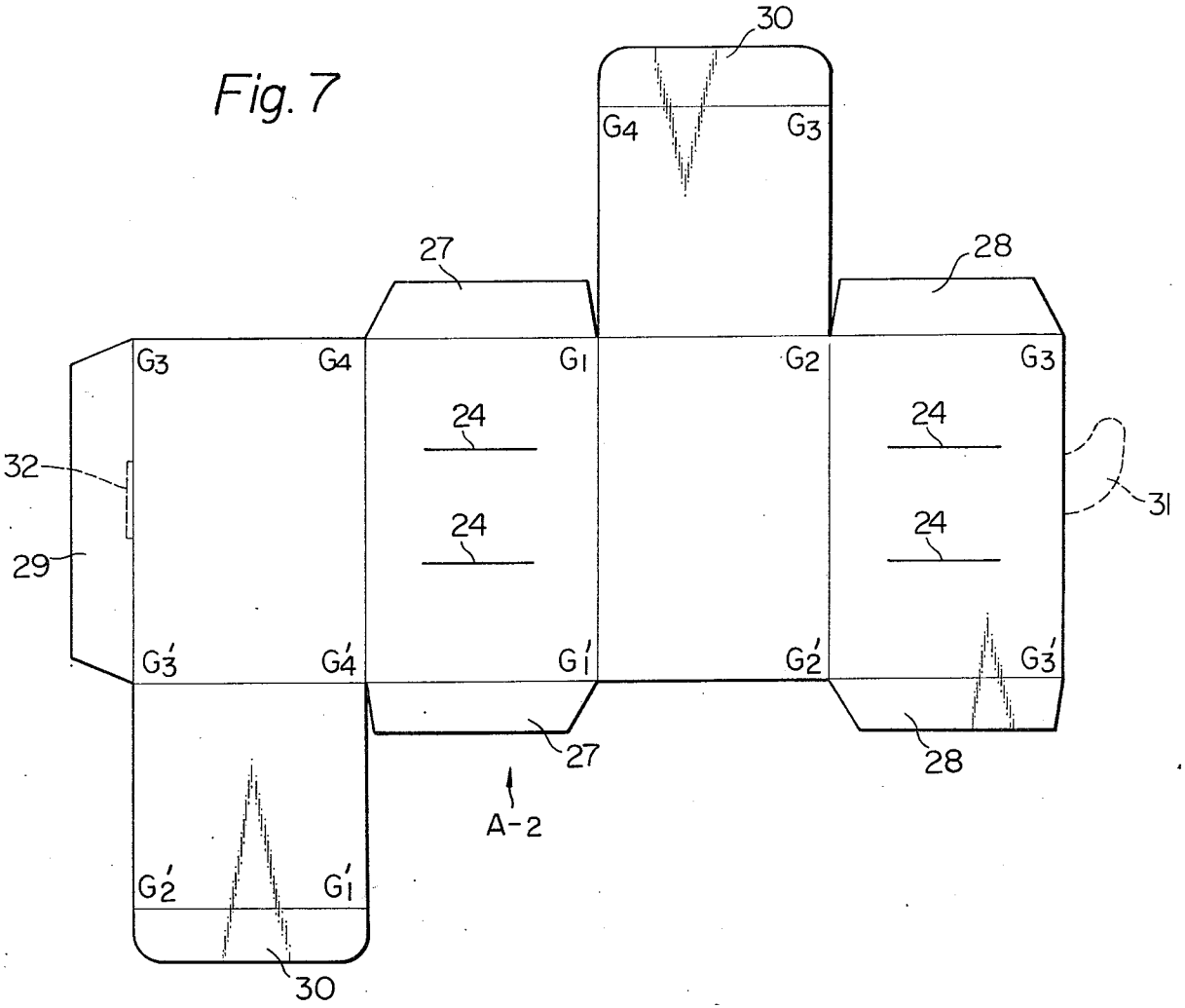
FIG. 7 is a view similar to FIG. 6 showing another inner box member for cooperating with the member of FIGS. 5 and 6 to constitute the H-shaped block unit as shown in FIG. 1.

FIG. 6 shows a developed view of the inner box member A-1, and FIG. 7 shows a developed view of the inner box member A-2. In FIGS. 5, 6 and 7, reference characters $E_1$, $E_2$ . . . indicate respective positions of the apexes $E_1$, $E_2$ . . . when the members A-1, A-2 and A-3 are assembled together to constitute the unit block as shown in FIG. 1.

A blank for forming the inner box member A-1 has, as shown in FIG. 6, a plurality of flaps 18, 19 and 20 which act as stiffening or tucking member, four slits 23 for receiving tab portion 13 of the outer closure member A-3, and a flap 20 formed on the leftside edge of the blank so as to be adhesively secured to the backside of the rightside edge $E_2E_2'$ of the blank.

The inner box member A-2 is formed of a blank shown in FIG. 7. It will not necessary to show any detailed description with respect to the box forming procedure such as scoring the lines on the sheet materials, folding along the score lines, forming a box-like shape, inserting suitable flaps so as to form a box of a predetermined shape.

Similarly, the unit block B shown in FIGS. 3A and 3B is constructed from an inner box member B-1, an inner box member B-2 and an outer closure member B-3. The inner box member B-1 has a configuration same to that of the inner box member A-1. The inner box member B-2 has a configuration of a parallelepiped $J_1G_1G_2J_2J_2'G_2'G_1'J_1'$.

The unit block C comprises two inner box members C-1, one inner box member C-2 and an outer closure member C-3. The inner box member C-2 has a configuration of a parallelepiped $G_1N_1N_4G_4G_4'N_4'N_1'G_1'$. Thus the configuration of the inner box member C-1 and that of the outer closure member C-3 will be self-explanatory from FIGS. 3A and 3B.

The unit block D comprises an inner box member D-1, an inner box member D-2 and an outer closure member D-3. The configuration of the inner box member D-1 is a parallelepiped $L_1L_1'L_4'L_4E_{40}E_{40}'E_{10}'E_{10}$.

The developed views of the inner box members B-1, B-2, C-1, C-2, D-1 and D-2 and the outer closure members B-3, C-3 and D-3 are omitted, but such members will easily be formed of suitable blanks from the description relating to the members A-1, A-2 and A-3.

In FIG. 5, it will be noted that each of the tabs 13 and 14 has a notched portion 17 which cooperate with an edge of corresponding slit 23 or 24 to prevent the disengagement.

As clear from the foregoing, each of the unit blocks is formed of a sheet material by means of a relatively simple folding and inserting operation and, it is relatively easy to disassemble into the outer closure member and the inner box members having collapsible character. Thus the assembly can be stored in a limited space and is light in weight.

Although the invention has been described as applied to a preferred embodiment, it will be clear that many modifications will be easily performed within the scope of the invention claimed.

I claim:

1. A combination of block units comprising:

a generally H-shaped block unit having a configuration including two symmetrical grooves extending in Y-axis direction in a basic rectangular parallelpiped having X-, Y- and Z-axes intersecting with the right angle with each other, each of said grooves has a base wall which is parallel with X-axis and oppositely inclining side walls intersecting with the base wall with an acute angle, the distance between the centerlines extending in Y-axis direction on the side walls being half of the length of said parallel-piped in the X-axis direction, a generally T-shaped block unit having a configuration attained by bisecting the H-shaped block unit along the X- and Z-axes thereof, a generally U-shaped block unit having a configuration attained by bisecting the H-shaped block unit along the X- and Y-axes thereof, and a generally T-shaped block unit having a configuration complementary to the U-shaped block unit.

2. A combination of block units as set forth in claim 1, in which each of the block units comprises an outer closure member and two or more inner box members; said outer closure member has four side faces enclosing the block unit around one of the X-, Y- and Z-axes and a plurality of flaps, each of said flaps is folded onto at least one of the side surfaces of respective inner box members and has a tab portion at the free end thereof for removably inserting into a slit formed in at least one of the side surfaces of the inner box members.

3. A combination of block units as set forth in claim 2, in which said four side faces are permanently secured to adjacent side faces with each other.

4. A combination of block units as set forth in claim 2, in which said one of the X-, Y- and Z-axes is the Z-axis.

5. A combination of block units as set forth in claim 2, in which each of said outer closure members and the inner box members is formed of sheet material.

6. A combination of block units as set forth in claim 5, in which each of the inner box members is collapsibly formed of a blank of said sheet material.

* * * * *